United States Patent [19]

Dougherty

[11] Patent Number: 4,553,686

[45] Date of Patent: Nov. 19, 1985

[54] DROP DISPENSER

[75] Inventor: Delford O. Dougherty, Shaker Heights, Ohio

[73] Assignee: St. Luke's Hospital, Cleveland, Ohio

[21] Appl. No.: 611,473

[22] Filed: May 17, 1984

[51] Int. Cl.[4] ..... B65D 47/18

[52] U.S. Cl. ..... 222/212; 222/422; 222/494; 604/298

[58] Field of Search ..... 222/420, 422, 212, 213, 222/207, 490, 494, 491, 528, 529, 547, 564, 527; 604/295-300; 138/89, 119; 174/DIG. 8

[56] References Cited

U.S. PATENT DOCUMENTS

| | | | |
|---|---|---|---|
| 1,738,080 | 12/1929 | Smith | 222/490 |
| 2,632,904 | 3/1953 | Halecky | 15/137 |
| 2,665,826 | 1/1954 | Mahoney | 222/422 |
| 2,734,665 | 2/1956 | Flamm | 222/207 |
| 2,962,192 | 11/1960 | Volckening | 222/107 |
| 3,107,035 | 10/1963 | Cholet | 222/213 |
| 3,184,121 | 5/1965 | Volckening | 222/213 |
| 3,825,157 | 7/1974 | Herzig | 222/212 |
| 4,138,040 | 2/1979 | Stock | 222/527 X |
| 4,328,912 | 5/1982 | Haggar et al. | 222/212 |

FOREIGN PATENT DOCUMENTS

| | | | |
|---|---|---|---|
| 179851 | 3/1954 | Austria | 222/420 |
| 221876 | 6/1962 | Austria | 222/490 |
| 3452 | 12/1908 | United Kingdom | 222/490 |
| 1318462 | 5/1973 | United Kingdom | 222/420 |

*Primary Examiner*—Joseph J. Rolla
*Assistant Examiner*—Frederick R. Handren
*Attorney, Agent, or Firm*—Body, Vickers & Daniels

[57] ABSTRACT

An improved drop dispenser for use with a closed compressible container, which dispenser is comprised of a small diameter tubular dispenser member of a resilient plastic material deformed at the free end thereof to provide a normally closed, integral valve-like arrangement, which valve-like arrangement is pressure actuated and partially opens when pressure within the container increases.

2 Claims, 4 Drawing Figures

DROP DISPENSER

BACKGROUND OF THE INVENTION

The present invention pertains to the art of liquid dispensers, and, more particularly, to a dispensing device for accurately dispensing small droplets of liquid. The invention is particularly applicable for use as an eyedropper and will be described with particular reference thereto although it will be appreciated that the invention has other and broader applications.

Medicant drop dispensers of the type to which the present invention pertains are available in various sizes and shapes for the numerous medicines and solutions which are available for the care and comfort of the human eye. Heretofore, such dispensers have basically comprised a relatively small compressible plastic container or vial provided with a dispensing cap. The cap is generally provided with a dispensing member or nozzle having a small orifice or opening therethrough.

One problem associated with conventional eyedroppers is the difficulty of accurately controlling the amount of medicine dispensed, i.e., the number and size of drops dispensed. Most conventional eyedrop dispensers heretofore provided a minute orifice or opening in the nozzle or dispenser portion of the cap. The larger the opening, the less pressure required to be exerted on the container and the more freely the medicant is dispensed. To provide a slower dispensing rate, the orifice in the nozzle or dispenser member is usually restricted in size, which then requires more pressure to be exerted on the container to force the medicant through the smaller opening. This type of dispenser does not provide the accuracy and control necessary for today's medicants. Accurately controlling the rate and placement of the drops are especially important, since most medicants for the human eye are extremely expensive and a single drop can cost upwards of several dollars. Thus, the loss or waste of even a few drops can present a substantial expense.

An additional problem associated with most drop dispensers known heretofore is the transfer of bacteria from the eye or an external source to the sterile medicant within the container. As mentioned above, drop dispensers generally provide a minute orifice or opening in the nozzle portion of the cap, and have a continuous passageway communicating such orifice with the interior of the container and the medicant therein. Contact between the surface of the orifice or nozzle and the eye surface or another external surface can contaminate the nozzle with bacteria. Sterile medicant from the container can then come in contact with the bacteria on the nozzle when drops are being dispensed. The medicant at the orifice or tip area of the nozzle which is not dispensed is drawn back or can seep back into the sterile medicant and thereby contaminate it.

RELATED ART

U.S. Pat. Nos. 4,138,040 (Stock) and 2,783,919 (Amsell) illustrate previously known drop dispensing devices having elongated dispenser members. Each of the dispenser members has a continuous internal passageway of small cross-section extending therethrough. U.S. Pat. No. 3,572,558 (Hooker) discloses a drop dispenser having a capillary tube through which extends a drop conveying stem. The capillary tube is deformed to engage the step and prevent lengthwise movement thereof while affording a liquid passageway therebetween. As will be appreciated, as the cross-section of these passageways decreases the pressure necessary to force the liquid therethrough increases. These capillary passageways thus require a greater pressure to dispense the drops. Likewise, because only small amounts of liquid can flow through these passageways, transferring sufficient liquid to form a droplet requires the pressure be maintained for a longer period of time. Maintaining a constant pressure for even a short period of time is difficult. As a result it is more difficult to accurately control the dispensing of a drop with such dispensers. Further, the continuous passageway of such container facilitates the propagation of contaminants into the sterile medicant within the container.

SUMMARY OF THE INVENTION

The present invention contemplates a new and improved dispenser device for dispensing droplets of liquid which overcomes all the above-referred to difficulties and provides a liquid medicant dispenser which accurately dispenses droplets of liquid medicant at desired locations without waste, which dispenser is also generally less susceptible to contamination of the medicant within the container.

In accordance with the present invention there is provided an improved drop dispenser for use with a closed compressible container, which dispenser is comprised of a small diameter tubular dispenser member of a resilient plastic material having a drop dispensing free end, the free end being deformed to provide a normally closed, integral valve-like arrangement which is pressure actuated and assumes a partially open position when the pressure within the container increases a sufficient amount to cause elastic deformation of the resilient material forming the valve-like arrangement.

Preferably the dispenser member is a small diameter tube of circular cross-section formed of a resilient plastic material. The valve-like arrangement is provided by permanently deforming the external surface of the tube at the free end thereof. The deformation of the external surface redefines the inner passageway of the tube and forms the valve-like arrangement within the dispenser member, wherein opposed wall surfaces within said tube abut and assume a linear interface. In its normally closed position, the valve-like arrangement generally blocks or reduces the passageway through the dispenser member. When pressure is exerted on the container, the increased pressure of the fluid therefrom will yieldingly deform the resilient plastic material forming the valve-like arrangement and open the passageway to allow the flow of fluid therethrough. When the pressure within the container is removed, the arrangement resumes its normally closed position thereby blocking the passageway.

Additionally, by providing such deformation at the free end of the tube, the closing of the valve-like arrangement facilitates release of drops therefrom. Release of the droplet prevents drawback of any medicant exposed to the outer surface of the dispenser member, thereby reducing the likelihood of bacteria or contaminants on the outer surface of the dispenser member from contaminating medicant within the container.

OBJECTS

A principal object of the invention is the provision of a new and improved device for dispensing drops of liquid medicant which is simple and economical in construction and easy to use, and which affords more accurate control over the amount of liquid medicant dispensed therefrom.

Another object of the present invention is the provision of an improved drop dispenser wherein the medicant contained therein is less susceptible to contamination.

A further object of the present invention is the provision of an improved drop dispenser wherein a restriction integrally formed within the passageway of the dispenser member affects a valve-like arrangement to control flow of fluid therethrough in response to pressure differentials on opposite sides thereof.

A still further object of the present invention is to provide an improved drop dispenser wherein the plastic memory of a resilient plastic material is utilized in the dispenser member to provide a valve-like arrangement responsive to pressure of the fluid flowing through the dispenser member.

A still further object of the present invention is to provide a drop dispenser wherein the propagation of bacteria from the dispenser tip to the sterile medicant within the container is minimized.

DRAWINGS

The invention may take physical form in certain parts and arrangement of parts, a preferred embodiment of which will be described in detail in this specification and illustrated in the accompanying drawings wherein.

DETAILED DESCRIPTION OF THE PREFERRED EMBODIMENT

Figure 1:
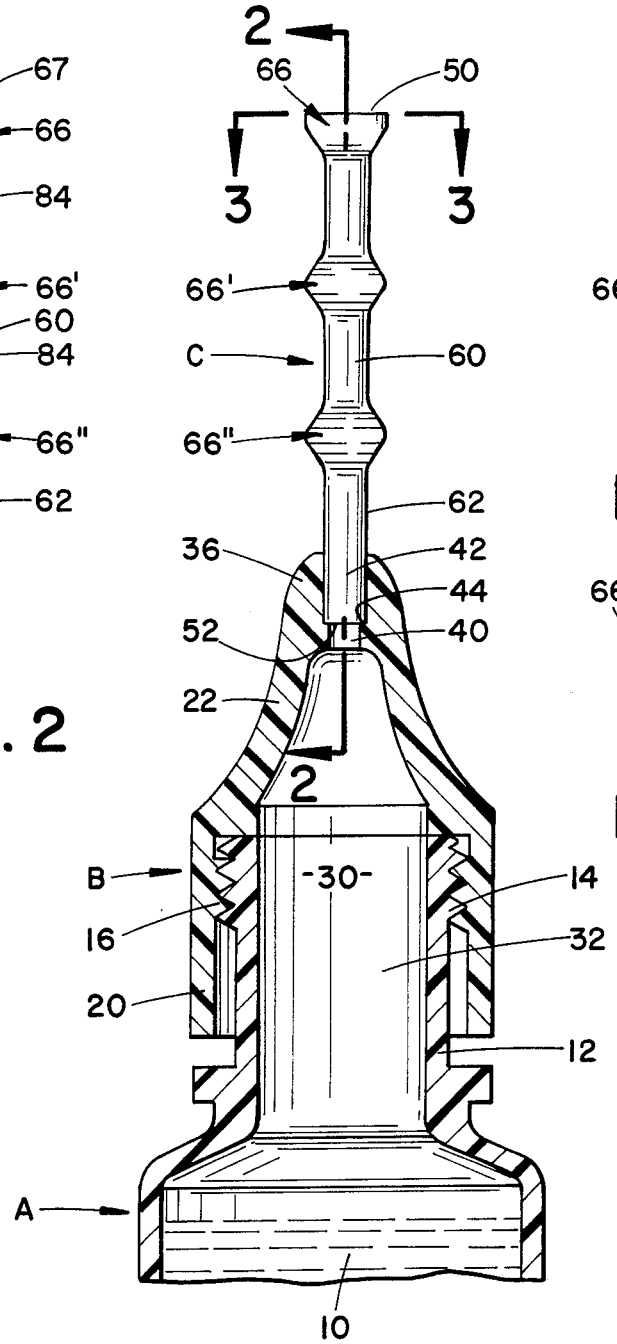
FIG. 1 is an enlarged, partial sectional view of a closure for a liquid medicant dispenser utilizing the preferred embodiment of the present invention.

Referring now to the drawings wherein the showing is for the purpose of illustrating a preferred embodiment of the invention only and not for the purpose of limiting the same, FIG. 1 shows an enlarged partial assembly of a liquid drop dispenser according to the present invention. The device is comprised of a compressible plastic container or vial A, a cap member B, and a dispenser member C. Container or vial A contains a supply of liquid 10, medicant for instance, to be dispensed in droplet form. Container A, in and of itself, forms no part of the present invention and is shown relatively conventionally. Normally, any plastic container or vial A which is commonly used in conjunction with an eyedrop dispenser would include a reduced diameter open neck portion 12 provided with external helical screw threads 14 over the uppermost part of the neck end portion as shown in FIG. 1. The screw threads 14 are adapted to matingly engage internal threads 16 on cap member B to thereby attach the latter in place on container A in liquid-tight relation thereto.

Cap member B comprises a generally cylindrical mounting or base portion 20 and a nozzle end portion 22 projecting endwise therefrom. An axial passageway 30 of varying diameter extends centrally through the cap member. A portion 32 of passageway 30, which extends through the base portion 20 of cap member B, is provided with the aforementioned helical screw threads 16, and is of a diameter to fit over and matingly engage with external threads 14 on the neck end portion 12 of container A to attach the same thereto. The nozzle end portion 22 of cap member B is of generally conical exterior shape tapering down in diameter from base portion 20 of the cap member to an outer apex or tip end 36. Within the nozzle end portion 22 of cap member B, axial passageway 30 therethrough decreases in diameter from portion 32 to a relatively small diameter bore opening 40 within the apex end 36. Beyond bore opening 40, axial passageway 30 generally increases in diameter to provide bore opening 42 at the extreme end of apex 36. An annular shoulder 44 is formed at the junction of bore openings 40 and 42. Extending from cap member B is dispenser member C. Dispenser member C is an elongated flexible tube of generally small diameter having a free end 50 and a fixed end 52. Fixed end 52 is secured liquid-tight to cap member B in bore opening 42.

The structure of the dispenser member as so far described is of generally conventional form such as employed in drop dispensers heretofore known. The present invention is generally comprised of improvements to drop dispenser member C. Dispenser member C is a generally straight flexible, small diameter tube 60 of a resilient plastic material. According to the preferred embodiment, tube 60 has a circular cross-sectional shape, with an outer surface 62 and an inner surface 64. More specifically, tube 60 is a thin walled Teflon® tube with an inner diameter of 0.022" and a wall thickness of 0.010". The length of tube 60 is not critical. Preferably, however, tube 60 is of sufficient length to enable free end 50 to be positioned near the surface of the eye in a drop dispensing position while container A is sufficiently removed therefrom to enable corrective eye wear to be worn by the user. In the preferred embodiment tube 60 is approximately 2" in length. As will be subsequently described and understood, tube 60 need not be Teflon®, or have a circular cross-section with the aforementioned dimensions. Any themoplastic material having resilient properties and generally similar dimensions may be used in making or forming tube 60.

Figure 3:
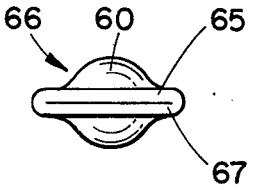
FIG. 3 is a cross-sectional view taken generally along line 3—3 of FIG. 1, and showing the valve-like arrangement of the present invention in a stable position; and, FIG. 4 is a cross-sectional view generally showing the valve-like arrangement of FIG. 3 in a valve open position.

According to the present invention, the uniform, generally circular cross-section of tube 60 is altered or distorted at the free end thereof to provide deformed portion 66. In the preferred embodiment, deformed portion 66 is formed by linear depressions or troughs generally transverse to the axis of tube 60. The structural shape of tube 60 at portion 66 is permanently altered or deformed in such a manner so as to create a restriction 68 within tube 60, wherein such restriction 68 assumes a valve-like arrangement at the end of tube 60 as seen in FIG. 3. The valve-like arrangement is the result of opposed portions 65 and 67 of wall surface 64 engaging each other and generating a linear interface 70 therebetween. At linear interface 70, the opposed portions 65 and 67 of inner wall surface 64 assume a generally flat contour. These flat portions 65 and 67 of the inner wall surface 64 and the engagement therebetween, effectively block the normal passageway through tube 60.

Restriction 68 at the end of tube 60 could possibly be molded, but according to the preferred invention, are formed by plasticly deforming, or altering the circular cross-sectional shape of the tube by pinching or crimping the sides of tube 60 at opposed points to collapse the walls thereof toward each other.

In the preferred embodiment, deformed area 66 and thus the restriction 68 are formed by two parallel, heated forming dies (not shown). In a manner which is readily apparent, deformed portion 66 of tube 60 can be formed by placing tube 60 between, and transversely to, the parallel,heated forming dies. The forming dies pinch or crimp the sides of the tube equally from opposed points thereon to collapse the opposed portions of the walls into abutting relationship to form the linear interface 70. The heat of the dies necessary to cause plastic deformation of the tube will of course depend on several factors such as the material used, the period of engagement between the tube and the heated dies, and the pressure exerted by the dies on the tube. As is appreciated, too much heat will fuse the inner wall sections together and permanently block the passageway of the tube. In this respect, any combination of the above factors may be used, so long as the opposed portions of the inner wall surfaces are maintained in engagement after deformation but are not permanently fused together.

Figure 4:
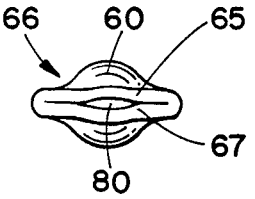

Restriction 68 has a first stable, normally closed position obstructing the passageway through dispenser member C as best seen in FIG. 3. When drops are to be dispensed, squeezing container A increases the pressure on the medicant or liquid therein and exerts an outward force on inner surface 64 of tube 60. At restriction 68, because of the resiliency of the plastic material, the force of the liquid separates wall portions 65 and 67 to effect an opening 80 therebetween, as seen in FIG. 4. Opening 80 is the result of the elastic deformation of the resilient plastic material in the area of deformation 66. The size of opening 80 will depend on the level of pressure exerted on the fluid and the resiliency of the plastic material forming tube 60. As the force exerted on the container A is released, the pressure of the liquid will likewise decrease. As the pressure on each side of the restriction equalizes the resilient properties of the plastic material will overcome the fluid pressure and return the restriction to its original stable, normally closed configuration blocking the passageway. The elastic or yielding movement of the deformed portions of the tube provides for more effective control of the drops dispensed from the container.

As previously discussed, drop dispensers with fixed constant passageways can either have a large diameter passageway wherein slight changes in pressure produce or release a large flow of fluid; or have an extremely small diameter opening wherein large changes in pressure are required to dispense the drops. With the present invention, greater control is provided because of an initial increase in pressure is necessary to effect opening or separation of the valve-like arrangement of restriction 68. Thereafter, such pressure must be maintained to maintain the opening therethrough. Any further increases of pressure will both increase the size of the opening and increase the flow of fluid therethrough. Valve-like restriction 68 also quickly decreases flow upon release of the pressure. Thus flow rate gradually increases when force is exerted on the dispenser but is quickly reduced when pressure is released.

Not only does this restriction provide more control over the drops dispensed, the valve-like arrangement inhibits the propagation of bacteria from the dispenser tip into the container. Restriction 68 at free end 50 of dispenser member C insures that medicant which flows through tube 60 and past the free end is dispensed therefrom. When restriction 68 resumes its initial stable position, it basically pinches-off or squeezes-out any drop that is formed thereon. In this respect, droplets exposed to the exterior surface of the dispenser member are less likely to remain on the dispenser tip end 50 or to be drawn back into container A. The closing or sealing arrangement of restriction 68, and the tendency of the restriction to pinch-off or drop-off exposed medicant, makes propagation of bacteria into the container substantially less likely.

Figure 2:
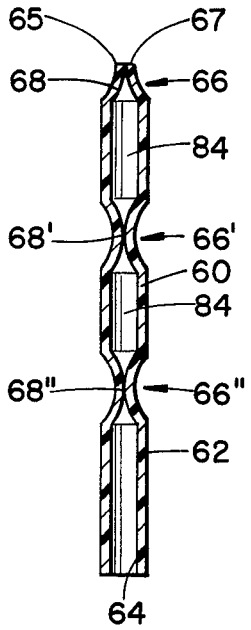
FIG. 2 is a cross sectional view taken generally along line 2—2 of FIG. 1.

In addition to deformed portion 66 at free end 50 of tube 60, other deformed portions 66' and 66'', may be provided along the length thereof as shown in FIGS. 1 and 2. Like deformed portion 66 these deformed areas define restrictions 68' and 68'' within tube 60. Each additional deformed area creates a valve-like arrangement which further obstructs passage through tube 60, and defines successive chambers 84 in dispenser member C as seen in FIG. 2. The additional restrictions 68' and 68'' further obstruct flow through tube 60. Each restriction must be successively overcome to permit dispensing of a drop. These multiple restrictions create a slower dispensing rate for more accurate control.

Other uses and additional modifications or alterations will occur to others upon their reading and understanding of the specification. It is intended that all such modifications and alterations be included insofar as they come within the scope of the invention as claimed or the equivalence thereof.

Having thus defined the invention, the following is claimed:

1. An eye drop dispensing arrangement for dispensing individual droplets, comprising in combination: a closed compressible plastic container; a cap member including means for securing said closure liquid-tight to said container; and an elongated dispenser tube extending from said cap member with a drop dispensing free end substantially spaced therefrom, said tube being formed of a resilient thermoplastic material having an outer diameter of about 0.042 inches and an inner wall surface defining a passageway communicating the interior of said container with said drop dispensing free end, the walls of said tube at said free end being permanently heat deformed on opposed sides of said tube by transverse depressions such that opposed portions of said inner wall surface abut along a linear interface to provide a normally closed, resilient, integral valve-like arrangement, said valve-like arrangement slightly opening when the pressure within said container increases a sufficient amount to cause yielding deformation of the deformed end to permit individual droplets to form and be dispensed.

2. An eye drop dispensing arrangement comprising in combination a closed compressible plastic container, a cap member including means for securing said closure liquid-tight to said container, and an elongated dispenser tube of uniform circular cross-section extending from said cap member with a drop dispensing free end substantially spaced therefrom, said tube being formed of a resilient thermoplastic material having an outer diameter of about 0.042 inches and an inner wall surface defining a passageway communicating the interior of said container with said drop dispensing free end, the walls of said tube at said free end and at several positions along the length thereof being permanently heat deformed on opposed sides by transverse depressions such that opposed portions of said inner wall surface abut to provide normally closed integral valve-like arrangements having chambers therebetween, each of said valve-like arrangements opening when the pressure within said container increases a sufficient amount to cause yielding deformation of the thermoplastic material forming such valve-like arrangements.

* * * * *